US008747243B2

(12) United States Patent
Gibbs et al.

(10) Patent No.: US 8,747,243 B2
(45) Date of Patent: Jun. 10, 2014

(54) GOLF SWING TRAINING DEVICE

(76) Inventors: Robert H. Gibbs, St. George, UT (US); Michael P. Smith, St. George, UT (US)

( * ) Notice: Subject to any disclaimer, the term of this patent is extended or adjusted under 35 U.S.C. 154(b) by 0 days.

(21) Appl. No.: 13/489,791

(22) Filed: Jun. 6, 2012

(65) Prior Publication Data

US 2012/0309554 A1 Dec. 6, 2012

Related U.S. Application Data

(60) Provisional application No. 61/493,854, filed on Jun. 6, 2011.

(51) Int. Cl.
*A63B 69/36* (2006.01)

(52) U.S. Cl.
USPC ..... 473/218; 473/270; 473/409

(58) Field of Classification Search
USPC ..... 473/218, 219, 231, 238, 257, 266, 270, 473/409
See application file for complete search history.

(56) References Cited

U.S. PATENT DOCUMENTS

| | | | | | |
|---|---|---|---|---|---|
| 3,580,584 | A * | 5/1971 | Trosko | ..... | 473/218 |
| 3,658,344 | A * | 4/1972 | Kimble | ..... | 473/272 |
| 4,478,422 | A * | 10/1984 | Blanchard | ..... | 473/272 |
| 5,209,484 | A * | 5/1993 | Randall | ..... | 473/265 |
| 5,993,326 | A * | 11/1999 | Hitchman et al. | ..... | 473/257 |
| 6,945,875 | B2 * | 9/2005 | Gauer | ..... | 473/270 |
| 2001/0003104 | A1 * | 6/2001 | Binduga | ..... | 473/221 |

* cited by examiner

*Primary Examiner* — Nini Legesse
(74) *Attorney, Agent, or Firm* — S. Brandon Owen

(57) ABSTRACT

The present disclosure relates to a golf swing training device that gives real-time visual feedback for obtaining correct golf club swing mechanics. Features and implementations include: (1) a number of alignment indicators such as disks or blocks capable of lying flat on the ground or a surface; (2) a cable, string, rope, or chain that connects the alignment indicators and that the alignment indicators are spaced along; (3) a positioning guide placed on the ground or a surface that indicates proper placement of the connected alignment indicators in order to create the proper arc shape of the connected alignment indicators; and (4) alignment markers on each alignment indicator to show the proper angle the golf club face should have at different points during a swing.

3 Claims, 6 Drawing Sheets

GOLF SWING TRAINING DEVICE

PRIORITY STATEMENT

The present application claims priority to U.S. Provisional Application No. 61/493,854, filed Jun. 6, 2011 entitled Golf Swing Training Device.

BACKGROUND OF THE INVENTION

1. Field of the Invention

The instant disclosure relates to a golf swing training device that gives immediate feedback for obtaining correct golf club swing arc, golf club face angle within the arc during swing, hand positioning during swing, club and feet alignment, and knee position at the top of backswing and at the follow through position.

2. Background and Related Art

When a golfer swings a golf club for the first time in order to strike a golf ball, he/she will often try to bring the club straight back during the backswing and then straight through on the forward swing; thus, keeping the face of the club closed during the backswing and open coming through the forward swing. The mistake made is that the person swinging the club perceives that the club must go straight back and straight through and the club face must stay square to that line, in order to hit the ball straight. The result of doing this is that the golfer never strikes the ball properly, resulting in lack of distance and direction.

Beginning golfers often become frustrated because they have a very difficult time hitting a stationary ball and cannot control the flight of the ball. Beginning golfers also do not understand how the swing works through the impact zone.

Most golf swing devices do not give the golfer immediate feedback during their golf swing that would indicate the following:

1) Correct arch of a golf swing—Inside to inside the arch swing;

2) A visual of the golfer's position and golf club head angle within the golf swing arch;

3) Easy to correct golf swing trajectory path;

4) Correct hand positioning during the swing—giving most productive impact on the ball;

5) Durability and portability;

6) Easy to setup and use.

The disclosed golf swing device helps golfers to overcome these and other challenges.

SUMMARY

Some embodiments described herein relate to a golf swing training device that gives immediate feedback for obtaining correct golf club swing arc, golf club face angle within the arc during the swing, hand and arm positioning during swing, club and feet alignment, and knee position at the top of backswing and at the follow through position. In some embodiments, the immediate feedback is real-time visual feedback. Certain embodiments provide a simple to setup and use golf swing training device that provides a method for striking a golf ball with full power while controlling the direction of the trajectory.

Some embodiments help a golfer to remember and use basic fundamentals of swinging a golf club the correct way. Certain embodiments will be used to teach the beginning golfer to understand three basic swing laws:

1) The golfer must swing the club from inside to inside of the target line, where the target line represents the pathway on which the golfer desires the ball to travel. Inside of the target line means that the club is located on the golfer's side of the target line, instead of on the side further away from the golfer. The golf swing, therefore, has to be around the golfer's body, which makes the club swing inside to inside of the target line. The golf swing device makes sure that the golfer receives immediate feedback as to whether or not his/her swing is inside to inside the swing arc and is therefore in accordance with this basic swing law.

2) The golf club face swings perpendicular to the inside to inside path. The club face swings like a gate opening on the way back and closing on the way through. The club face starts square and opens up on the way back and then when coming through to the ball it must come back square to the ball. After striking the ball the club face must close as it follows the path of the golf swing device. As the golf club travels during the back swing and forward swing, the club face is substantially perpendicular to the inside to inside path at all times. Some embodiments of the golf swing device assist the golfer in ensuring that the golf club is perpendicular to the inside to inside path throughout the golfer's swing.

3) The club face is only approximately 3 inches in width, and the golfer must hit the ball in the center of the club face. This gives the golfer only about one inch on the club face to squarely hit the ball. Most beginning golfers start the club face back in the right area but when they come down to the ball they throw the club well outside of the one inch area of the club face and either strike the ball with the heel of the club or miss it all together. In some embodiments, with the golf swing device in front of them, a golfer can, among other things, see how his/her hands and arms must stay closer to his/her body throughout the forward swing to bring the club back to the center hit. This assists the golfer in hitting the golf ball squarely.

Some embodiments give a visual representation of the arc that the golf club head should follow during a swing in reference to the target line. The invention also gives a visual representation of the proper angle that the golf club face should have during a swing such that the golf club face can always be substantially perpendicular to the arc path traced by the club head during a swing.

Features of one embodiment of the present disclosure include: (1) a number of alignment indicators such as disks or blocks capable of lying flat on the ground or a surface; (2) a cable, string, rope, chain or the like that connects the alignment indicators and along which the alignment indicators are spaced; (3) a positioning guide placed on the ground or a surface that indicates proper placement of the connected alignment indicators in order to create the proper arc shape of the connected alignment indicators; and (4) alignment markers on each alignment indicator to show the proper angle the golf club face should have at different points during a swing.

In certain embodiments, during the swinging motion, the golf club face will trace an arc outside the swing alignment device and the user's arms and hands will trace an arc inside the swing alignment device.

By using certain embodiments of the present disclosure, a golfer can also determine if he/she is moving his/her center during a swing and can use the device to maintain correct upper and lower body posture and rotation, to keep the back elbow next to the body, and to keep the club on path.

In some embodiments, the following steps help the golfer to use the device as well as to remember basic fundamentals of swinging a golf club the correct way:

1. Path of Club in Reference to Target Line.

In some embodiments, with the correct golf stance, proper grip and alignment to the target line, the swing of the club head moves from inside the target line to inside of the target line when striking a golf ball. This is because the golfer is standing to the side of the target line thus it becomes a side swinging game.

2. Club Face Works Perpendicular to the Path of the Club Head.

In certain embodiments, passing the club face over the golf swing device, you can see the club face of the club move perpendicular to the path of the club. Thus, the club face opens up on the way back, returns to square on the way back to the ball and closes near the end of the path.

3. Swinging the Club on Path and Square Face at Impact Requires a Center Hit.

In certain embodiments, as the club face comes around to strike the ball, the arms and hands keep the club from moving beyond the arc of the swing to maintain a center hit on the ball.

4. Angle of Attack from Inside the Target Line.

In some embodiments, when the club comes down toward the ball on the inside to inside motion, the angle at which it descends allows the club to make a more shallow divot than the attack coming straight on to the target line. This allows for more club head speed through the ball.

5. Keeping Posture Constant throughout the Swing.

In certain embodiments, there is a certain distance from the navel of the golfer to the golf swing device when the golfer positions himself with a posture ready to begin his/her golf swing. If during the swing this distance seems to shorten (meaning the navel moves closer to the golf swing device), then that would likely force the golfer's spine up and lift the body posture causing the club to come up and out during the swing. In some embodiments, with the golf swing device in the golfer's sight he or she can see if the navel moves closer to the golf swing device during the swing thus keeping the correct posture, which allows the club to stay on path.

6. Keeping the Right Elbow Next to the Body to Lag the Club into the Hitting Zone.

In some embodiments, with the back swing at the top, the golfer looks and observes in slow motion the right elbow coming inside the golf swing device with the elbow next to the body moving it up to the $4^{th}$ alignment indicator on the golf swing device. This teaches the golfer to retain the angle created by the left wrist and right elbow.

7. Lower Body Centerline Rotation.

In some embodiments, the lower body center of the golfer is from the center of the groin up towards the navel. The golf swing device allows the hips to rotate with the club in a circular fashion both back and through with the lower centerline ahead of the club coming toward the ball continuously until the shot is finished.

8. Upper Body Centerline Rotation.

In certain embodiments, the upper body centerline in the golfer is from the bottom of the sternum up to the top of the sternum. This upper body center follows the lower body rotation coming with the club around the golf swing device keeping the hands and arms inside the golf swing device.

9. Using the Device to Find where the Speed Zone of the Swing is.

In some embodiments, when a golfer swings the club he/she usually produces speed too early in the swing. The concept is that during the swing you conserve energy going back in the backswing and expend the energy coming forward in the red zone.

BRIEF DESCRIPTION OF THE DRAWINGS

In order for the manner in which the above recited and other features and advantages of the present invention are obtained, a more particular description of the invention will be rendered by reference to a specific embodiment thereof, which are illustrated in the appended drawings. Understanding that the drawings depict only a typical embodiment of the present invention and are not, therefore, considered as limiting the scope of the invention, the present invention will be described and explained with additional specificity and detail through the use of the accompanying drawings in which.

DETAILED DESCRIPTION OF THE INVENTION

The present disclosure relates to a golf swing training device. FIGS. 1-9 and the corresponding discussion are intended to provide a general description of one exemplary embodiment in which the invention may be configured and implemented. One skilled in the art though, will appreciate that the disclosure may be embodied by a variety of configurations.

Figure 1:
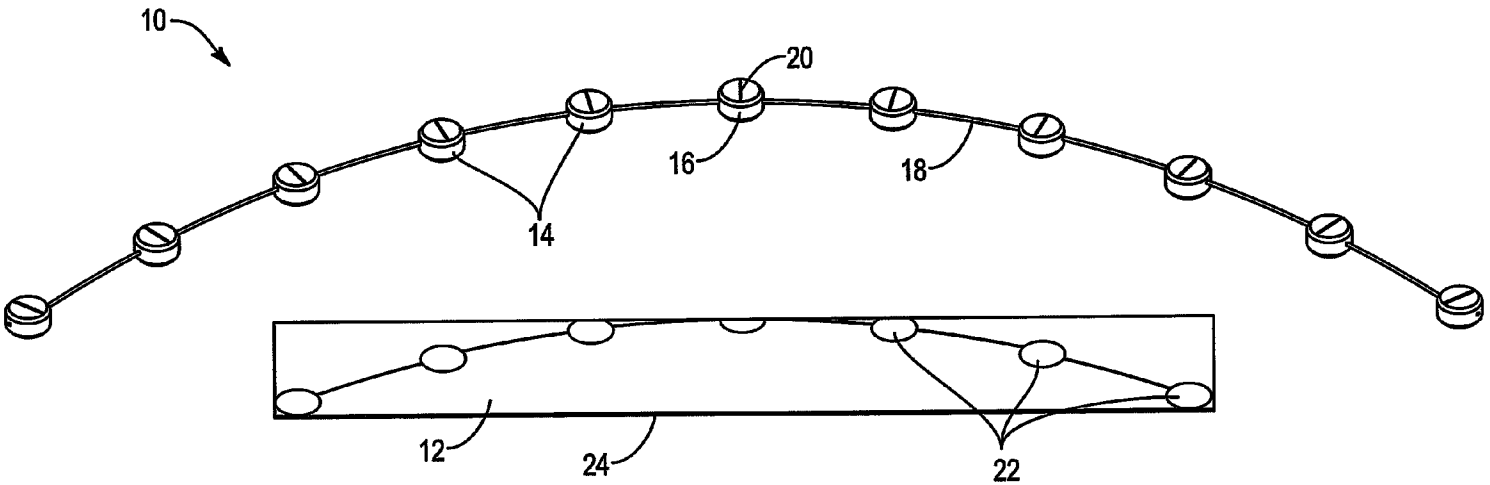
FIG. 1 illustrates components of one representative embodiment.
Figure 2:
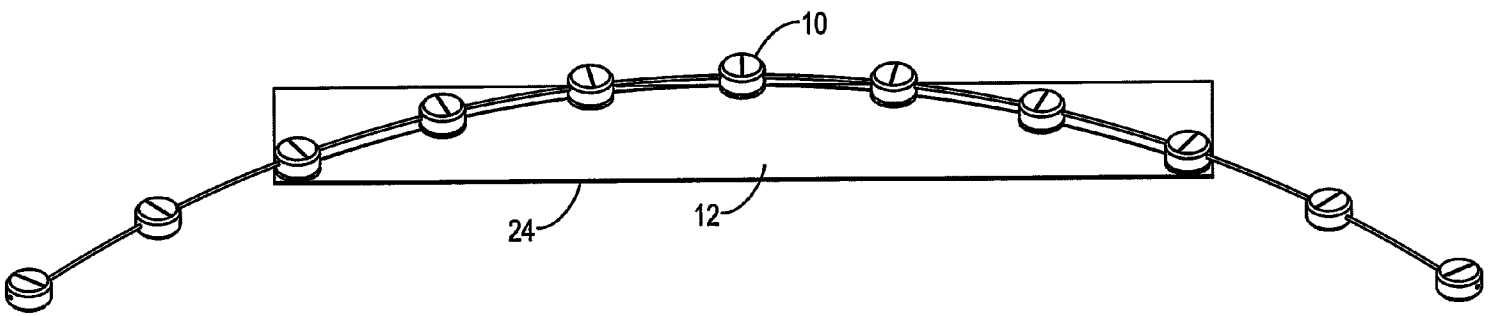
FIG. 2 illustrates components of one representative embodiment.

In FIG. 1, a swing alignment device 10 and a positioning guide 12 are represented. The swing alignment device 10 is comprised of alignment indicators 14, including a center alignment indicator 16, and a connecting cable 18. The embodiment shown in FIG. 1 has eleven alignment indicators 14. However, other embodiments have different numbers of alignment indicators 14, such as nine alignment indicators or any other number of alignment indicators 14 that work in a manner consistent with this disclosure. Each alignment indicator 14 is marked with an alignment marker 20. Placement indicators 22 and a bottom edge 24 on the positioning guide 12 indicate proper placement of alignment indicators 14, when the swing alignment device 10 is placed on the positioning guide 12 in order to create the proper arc shape of the swing alignment device 10. FIG. 2 represents an exemplary embodiment of the proper placement of the swing alignment device 10 onto the positioning guide 12.

Figure 3:
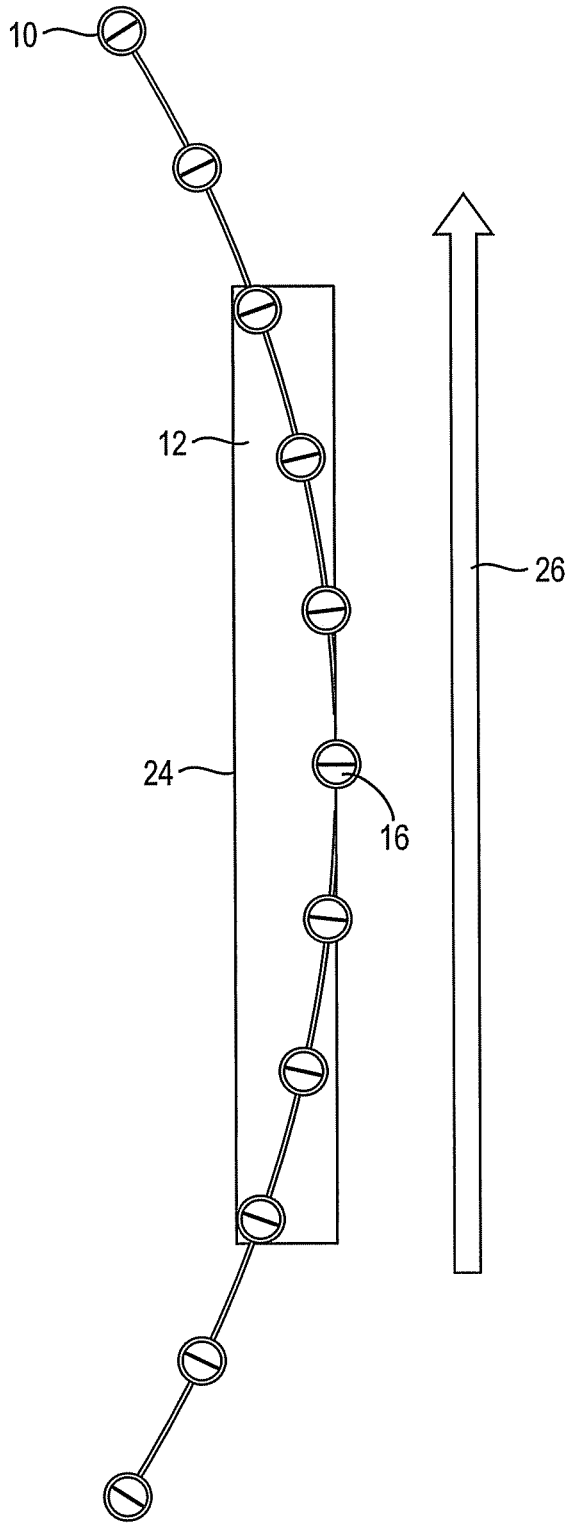
FIG. 3 illustrates a top plan view of one representative embodiment that includes the target line.

FIG. 3 is a top plan view representation of the swing alignment device 10 placed on the positioning guide 12. In this embodiment, a target line 26 represents the direction to the target for a right-handed golfer. Because target line 26 is parallel to positioning guide 12, positioning guide 12 is positioned to point to the target.

Figure 4:
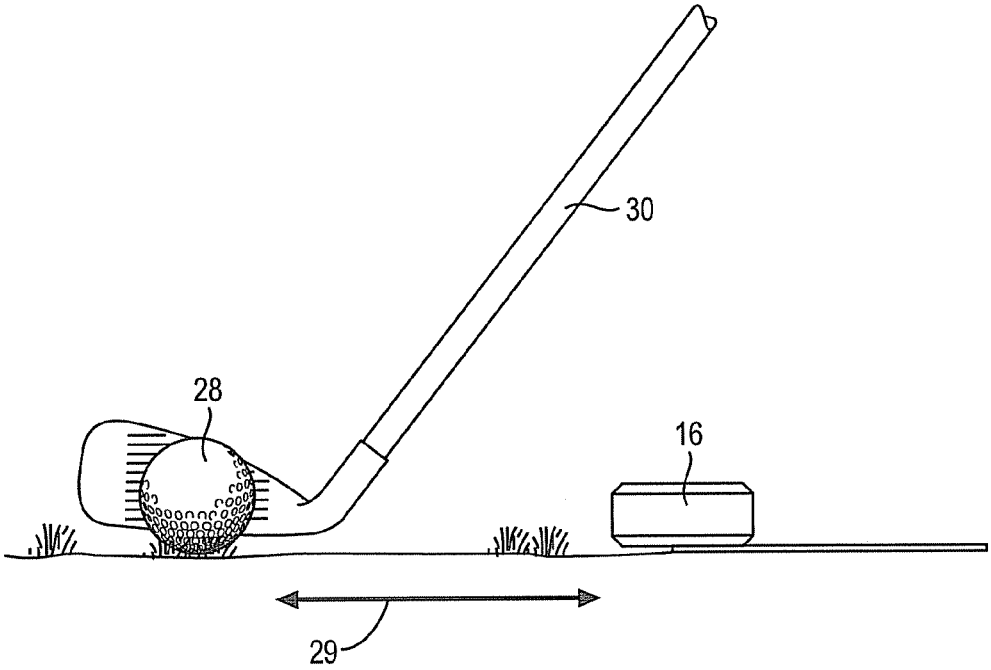
FIG. 4 illustrates the placement of golf ball 28 relative to one embodiment.
Figure 5:
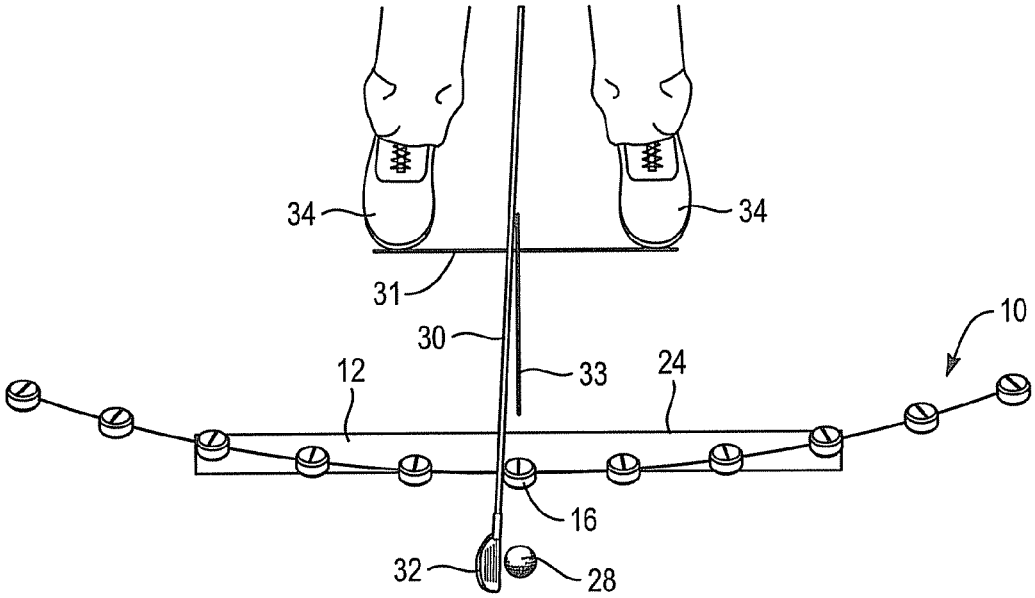
FIG. 5 illustrates an exemplary embodiment that includes a golfer.

FIGS. 4 and 5 represent embodiments showing the placement of a golf ball 28 relative to the swing alignment device 10. In certain embodiments, golf ball 28 is placed approximately six inches outside the arc created by the swing alignment device 10, measured from center alignment indicator 16. Arrow 29 shows the distance between the center alignment indicator 16 and a golf club 30. FIG. 4 also shows the golf club 30 positioned ready to begin the golfer's swing and positioned next to golf ball 28.

FIG. 5 also represents the proper position of a golfer when using certain embodiments of the present disclosure. The golf club 30 is positioned so that a golf club face 32 is just behind golf ball 28. A golfer's feet 34 are centered directly behind center alignment indicator 16 at a distance determined by the length of golf club 30. The golfer's feet 34 are positioned parallel to bottom edge 24 of positioning guide 12 in order to aim towards the target. This parallel positioning of the golfer's feet 34 are also shown by lines 31 and 33.

Figure 6:
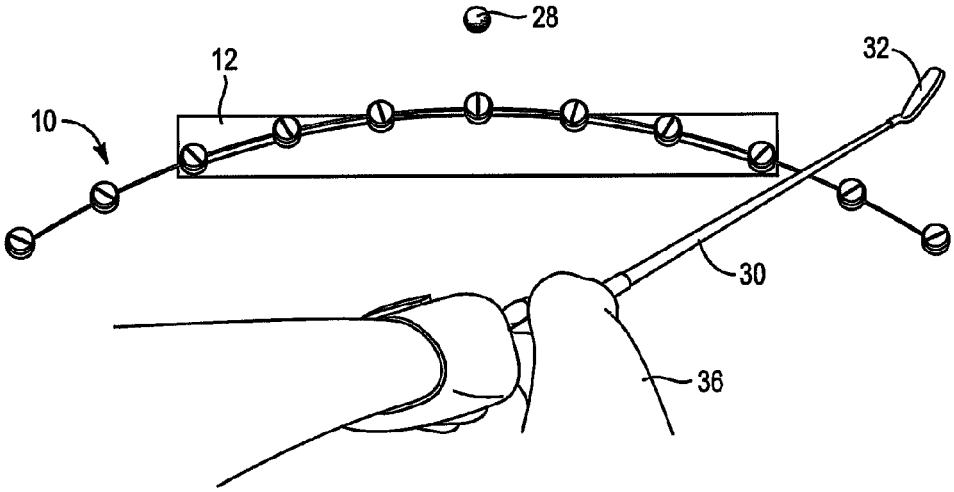
FIG. 6 illustrates one embodiment that shows a golfer during the backswing motion of the golfer's swing.

FIG. 6 is an embodiment during the swinging motion from the perspective of a user. The user swings the golf club 30 so that the club face 32 of golf club 30 is visibly outside the arc made by the swing alignment device 10 and the user's hands 36 are visibly inside the arc made by the swing alignment device 10. During the swinging motion, the golf club face 32 will trace an arc just outside the swing alignment device 10, hitting golf ball 28, and the user's hands 36 will trace an arc just inside the swing alignment device.

Figure 7:
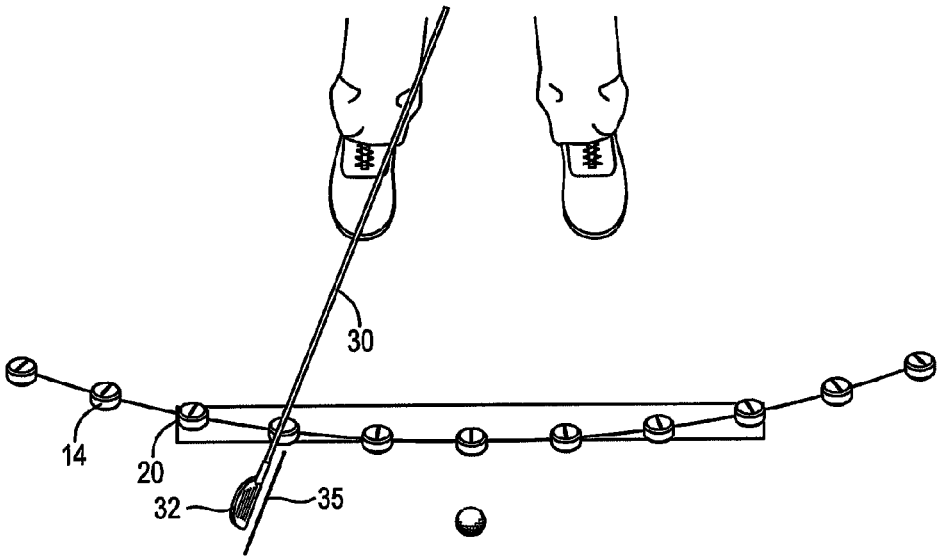
FIG. 7 is another illustration of one embodiment during the swinging motion of a user.

FIG. 7 is another representation during the swinging motion. The golf club face 32 is positioned to align with the alignment markers 20 on each of the alignment indicators 14. As the golf club 30 is drawn back and then swung forward, the alignment markers 20 on each alignment indicator 14 indicate the proper angle of the golf club face 32 throughout the swing. Line 35 shows an example of the proper angle of golf club face 32 as well as the alignment marker 20 (not shown) that is nearest the golf club face 32 in this FIG. 7.

Figure 8:
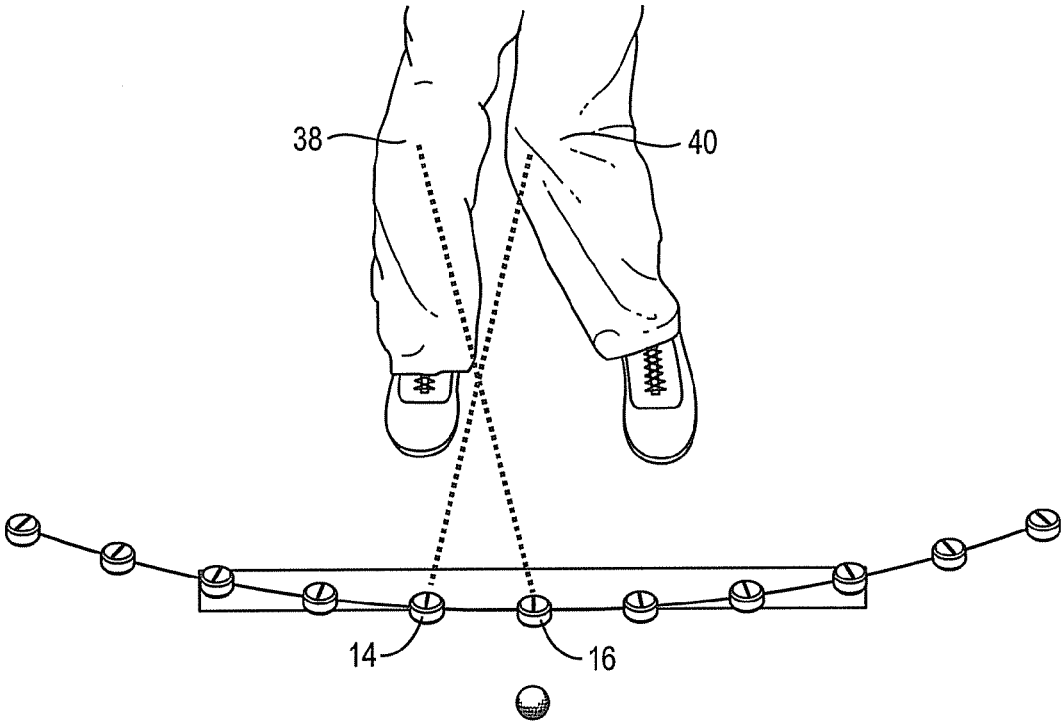
FIG. 8 is an illustration of one embodiment at the instant a right-handed user is at the top of his/her backswing.

FIG. 8 is a representative embodiment at the moment a right-handed user is at the top of his/her backswing. Proper position of the user's back knee 38 is indicated by pointing the back knee 38 toward center alignment indicator 16. Proper position of the user's forward knee 40 is indicated by pointing it toward the alignment indicator 14 that is one position behind center alignment indicator 16. For left-handed users, the forward and back knees are reversed.

Figure 9:
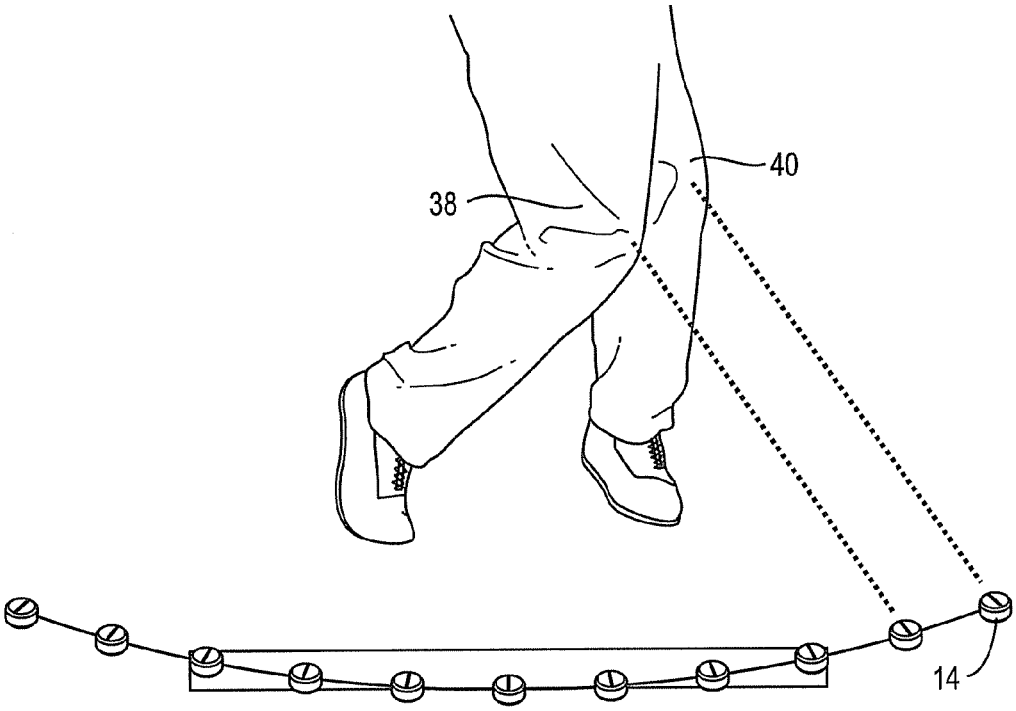
FIG. 9 is an illustration of one embodiment at the time a right-handed user is in the follow through position of his/her swing.

FIG. 9 is a representative embodiment at the time a right-handed user is in the follow through position of his/her swing. Proper position of the user's forward knee 40 is indicated by pointing it to the last alignment indicator 14 in the target direction, and proper position of the user's back knee 38 is indicated by pointing it toward the alignment indicator 14 one position behind the last alignment indicator 14. For left-handed users, the forward and back knees are reversed.

Certain embodiments are made by the following manufacturing process. The alignment indicators, embodied as disks or pucks in this example, are made from 0.743-inch thickness expanded PVC sheets (alternate materials may be used such as high grade plastics created via injection molding, which will eliminate the need for routing, drilling, and chamfering each disk. The measurements, however, remain the same). Each disk is cut by using either an NC Router or a 2-inch hole saw. A chamfer is placed on the top and bottom of each disk in order to create a tapered edge. A 7/64th drill is used to make the hole through the disk. Drilling a 1.250-inch deep hole with a 7/64th drill makes the end holes.

The disks are strung on a 3/32 galvanized cable, with a 3/32-inch vinyl coating 59 inches long and glued in place, at 5.825 inch centers. The cable is stripped at each end of 1/4 inch coating to ensure the stress is placed on the galvanized cable and not the coating, thus eliminating any stretching of the device. An assembly jig allows a precise assembly. The disks are placed in the jig in prescribed locations. The cable is then drawn through the discs and glue is applied to the cable prior to being pulled into the final hole location in the disk. The device is allowed to dry for 15 minutes then prepared for packaging.

The present disclosure may be embodied in other specific forms without departing from its spirit or essential characteristics. The described embodiments are to be considered in all respects only as illustrative and not restrictive.

What is claimed is:

1. A golf swing training device comprising:

a swing alignment device, wherein the swing alignment device forms an indicator of proper golf swing mechanics, the swing alignment device comprising alignment indicators, the alignment indicators having alignment markers allowing a golfer to orient a golf club face substantially perpendicular to a swing path comprising an arc;

a positioning guide, wherein the swing alignment device is placed on the positioning guide to form the proper shape of the swing alignment device; and alignment indicator connectors, the alignment indicator connectors selectively connecting the alignment indicators, wherein the alignment indicator connectors are selected from a group consisting of rope, string, chain, wire, and cable.

2. The apparatus of claim 1, wherein the positioning guide further includes placement indicators for proper placement of said swing alignment device onto the positioning guide.

3. A method of training proper golf swing mechanics, the method comprising the steps of:

placing a positioning guide on a surface;

placing a swing alignment device onto the positioning guide;

placing a golf ball in alignment with the swing alignment device;

aligning the golf club and a golfer's feet with the swing alignment device and the positioning guide;

swinging the golf club so that a club head of the golf club is outside the swing alignment device and the golfer's hands and arms are inside the swing alignment device;

aligning a golf club face with at least one alignment marker on at least one alignment indicator of the swing alignment device, wherein the aligning the golf club face comprises orienting the golf club face substantially perpendicular to at least one alignment marker;

swinging the golf club so that the golf club face aligns with the at least one alignment marker of the at least one alignment indicator;

aligning a golfer's back knee with a center alignment indicator of the swing alignment device at a top of a golfer's backswing motion;

aligning a golfer's forward knee with an alignment indicator one position behind the center alignment indicator at the top of the backswing motion;

aligning the golfer's forward knee with a last alignment indicator of the swing alignment device at an end of the follow through motion; and aligning the golfer's back knee with an alignment indicator one position behind said last alignment indicator at the end of the follow through motion.

* * * * *